US010145550B2

(12) United States Patent
Johnson

(10) Patent No.: US 10,145,550 B2
(45) Date of Patent: Dec. 4, 2018

(54) LIGHTING UNIT

(71) Applicant: Aurora Limited, St Albans (GB)

(72) Inventor: Andrew Johnson, St Albans (GB)

(73) Assignee: AURORA LIMITED, Welwyn Garden City (GB)

( * ) Notice: Subject to any disclaimer, the term of this patent is extended or adjusted under 35 U.S.C. 154(b) by 69 days.

(21) Appl. No.: 15/024,038

(22) PCT Filed: Sep. 23, 2014

(86) PCT No.: PCT/IB2014/064774

§ 371 (c)(1),
(2) Date: Mar. 23, 2016

(87) PCT Pub. No.: WO2015/040603

PCT Pub. Date: Mar. 26, 2015

(65) Prior Publication Data

US 2016/0209018 A1 Jul. 21, 2016

(30) Foreign Application Priority Data

Sep. 23, 2013 (GB) ..... 1316817.4

(51) Int. Cl.
*F21V 25/12* (2006.01)
*F21V 29/00* (2015.01)
(Continued)

(52) U.S. Cl.
CPC ..... *F21V 25/125* (2013.01); *F21S 8/02* (2013.01); *F21S 8/026* (2013.01); *F21V 21/047* (2013.01);
(Continued)

(58) Field of Classification Search
CPC ..... F21V 25/125; F21V 29/777; F21V 29/89; F21V 29/70; F21V 29/004; F21V 21/047;
(Continued)

(56) References Cited

U.S. PATENT DOCUMENTS 7,320,536 B2 * 1/2008 Petrakis ..... F21V 25/00 362/147
2007/0206374 A1 * 9/2007 Petrakis ..... F21V 25/00 362/147

(Continued)

*Primary Examiner* — Joseph L Williams
*Assistant Examiner* — Jose M Diaz

(57) ABSTRACT

A downlight assembly comprising:—(i) a mounting ring having a tubular body with an opening at a rear, the mounting ring being formed from a material that withstands temperatures used for fire rating tests and having a lower peripheral annular flange extending outwardly from a bottom end of the tubular body, and an upper peripheral annular flange extending inwardly from an upper end of the tubular body, said upper peripheral annular flange enabling the rear of the mounting ring to be substantially closed if required; (ii) a solid state lighting element comprising one or more LEDs mounted on a circuit board formed from a material having a melting point lower than 1000 degrees C.; (iii) a heat sink formed from a material having a melting point lower than 1000 degrees C. and being in thermal contact with the solid state lighting element and located substantially outside the mounting ring; and (iv) intumescent material wherein the intumescent material is adapted to expand to fill or occlude the tubular body in the event of a fire.

14 Claims, 4 Drawing Sheets

(51) Int. Cl.

| | |
|---|---|
| ***F21S 8/02*** | (2006.01) |
| ***F21V 29/70*** | (2015.01) |
| ***F21V 29/77*** | (2015.01) |
| ***F21V 29/89*** | (2015.01) |
| ***F21V 21/04*** | (2006.01) |
| *F21V 19/00* | (2006.01) |
| *F21V 23/00* | (2015.01) |
| *F21Y 115/10* | (2016.01) |

(52) U.S. Cl.
CPC ..... *F21V 29/004* (2013.01); *F21V 29/70* (2015.01); *F21V 29/777* (2015.01); *F21V 29/89* (2015.01); *F21V 19/0035* (2013.01); *F21V 19/0055* (2013.01); *F21V 23/006* (2013.01); *F21Y 2115/10* (2016.08)

(58) Field of Classification Search
CPC ..... F21V 19/0055; F21V 19/0035; F21V 23/006; F21S 8/02; F21S 8/026; F21Y 2115/10
See application file for complete search history.

(56) References Cited

U.S. PATENT DOCUMENTS

2011/0273107 A1* 11/2011 Hsia ..... F21V 23/0457 315/250
2016/0238226 A1* 8/2016 Rashidi Doust ..... F21V 25/125

* cited by examiner

LIGHTING UNIT

TECHNICAL FIELD

This invention relates to improvements in a lighting unit, and in particular to a fire rated downlight using LED light source technology.

BACKGROUND ART

LED downlight fittings or downlighters are a form of lighting unit becoming more and more widely used as light sources in domestic and commercial environments. They offer significant energy savings when compared with traditional incandescent lighting, whilst being particularly neat and unobtrusive in their appearance, since almost the entire downlight fitting is concealed behind a ceiling or other suitable panel or surface, whilst giving out a pleasing light. However, LED downlights suffer from a number of disadvantages.

LED's generate significant amounts of heat. It is important to prevent overheating of the LEDs, and associated control circuit, since overheating will have obvious detrimental effects on the light output and service life of these components. Indeed, excessive temperatures will cause LEDs and electronic components to fail leading to premature failure of the lighting unit. To this end it is known to provide LED lighting units with cooling means in the form of a heat sink or a cooling fan to draw heat away from the lighting element to the rear of the lighting unit.

Additionally, their installation generally requires an aperture to be cut in a ceiling or other surface and that surface can be required by relevant Building Regulations to act as a fire barrier for typically between 30 minutes to 90 minutes. Downlights are generally installed into an aperture in the ceiling that has to be relatively wide to accommodate the downlight assembly and this thereby compromises the ability of the ceiling to contain a fire in a room below.

A fire rating is the ability to withstand a specified temperature for a period of time without failure. By way of example in UK building regulations, the specified temperature is around 1100 degrees C., but this will vary from country to country and test protocol to test protocol. It is therefore generally considered that materials with a melting point greater than 1000 degrees C. will withstand such fire tests, whereas downlights made from materials having a melting point less than 1000 degrees C. will not withstand the test conditions for 90 minutes. Thus a downlight made partly from aluminium would inevitably fail such a test.

However, there is a desire to use a solid state lighting element in fire rated fixtures, where the solid state lighting element is able efficiently to transfer heat to a heat sink, but this creates a problem in that many such LEDs are mounted on aluminium circuit boards which in turn are directly connected to aluminium heat sinks, and thus the combination of LED circuit board and heat sink has a melting point well below the requirement needed to achieve the required fire rating. In the case of aluminium the melting point is only in the region of 660 degrees C.

It is an advantage of the present invention that it allows for the use of a solid state lighting element/heat sink combination having a melting point lower than the temperature applied during fire rating testing, while allowing the downlight fixture to pass the fire rating test.

DISCLOSURE OF INVENTION

According to a first aspect of the present invention there is provided a downlight assembly according to claim 1. For example there is provided a downlight assembly comprising:—

(i) a mounting ring having a tubular body with an opening at a rear, the mounting ring being formed from a material that withstands temperatures used for fire rating tests and having a lower peripheral annular flange extending outwardly from a bottom end of the tubular body, and an upper peripheral annular flange extending inwardly from an upper end of the tubular body, said upper peripheral annular flange enabling the rear of the mounting ring to be substantially closed if required;

(ii) a solid state lighting element comprising one or more LEDs mounted on a circuit board formed from a material having a melting point lower than 1000 degrees C.;

(iii) a heat sink formed from a material having a melting point lower than 1000 degrees C. and being in thermal contact with the solid state lighting element and located substantially outside the mounting ring; and (iv) intumescent material wherein the intumescent material is adapted to expand to fill or occlude the tubular body of the mounting ring in the event of a fire.

This has as an advantage that in the event of a fire, the intumescent material expands to fill or occlude the tubular body and protect the heat sink and/or LED circuit board. Since in normal operation the heat of the solid state lighting element is efficiently transferred to the heat sink with which it is in contact, the heat is not sufficient to trigger the expansion of the intumescent material, thereby allowing normal operation of the downlight fixture.

Preferably the opening at the rear of the mounting ring is substantially closed by the heat sink.

In an alternative preferred embodiment the opening at the rear of the mounting ring is substantially closed by the solid state lighting element.

Preferably the intumescent material is in the form of a sleeve which may be continuous or discontinuous and preferably the intumescent sleeve covers half of the internal surface of the tubular body of the mounting ring.

Preferably a ring or washer of fireproof material or other non-thermally conductive material is located between the circuit board and the rear of the tubular body. More preferably, the ring or washer of fireproof material comprises an intumescent material. This ensures there is no indirect thermal contact between the PCB and the cylindrical casing.

Preferably the circuit board is formed from a material having a melting point between 600 and 900 degrees C. and more preferably from aluminium.

Preferably the heat sink extends through the opening of the tubular body into direct thermal contact with the solid state lighting element, with or without a thermally conductive interface between the LED circuit board and the heat sink.

So in summary a downlight assembly may comprise a casing having a tubular body with an opening at a rear, a solid state lighting element comprising a circuit board of material having a melting point lower than 1000 degrees C. located at the rear of the casing, a heat sink located against the rear of the casing to close the opening in the casing, the heat sink being in good thermal contact with the solid state lighting element, and intumescent material located within the tubular body in which the intumescent sleeve is adapted to expand radially relative to the tubular body in the event of a fire.

BRIEF DESCRIPTION OF DRAWINGS

The invention will now be described, by way of example only, in relation to the attached Figures in which.

MODES FOR CARRYING OUT THE INVENTION

Figure 1:
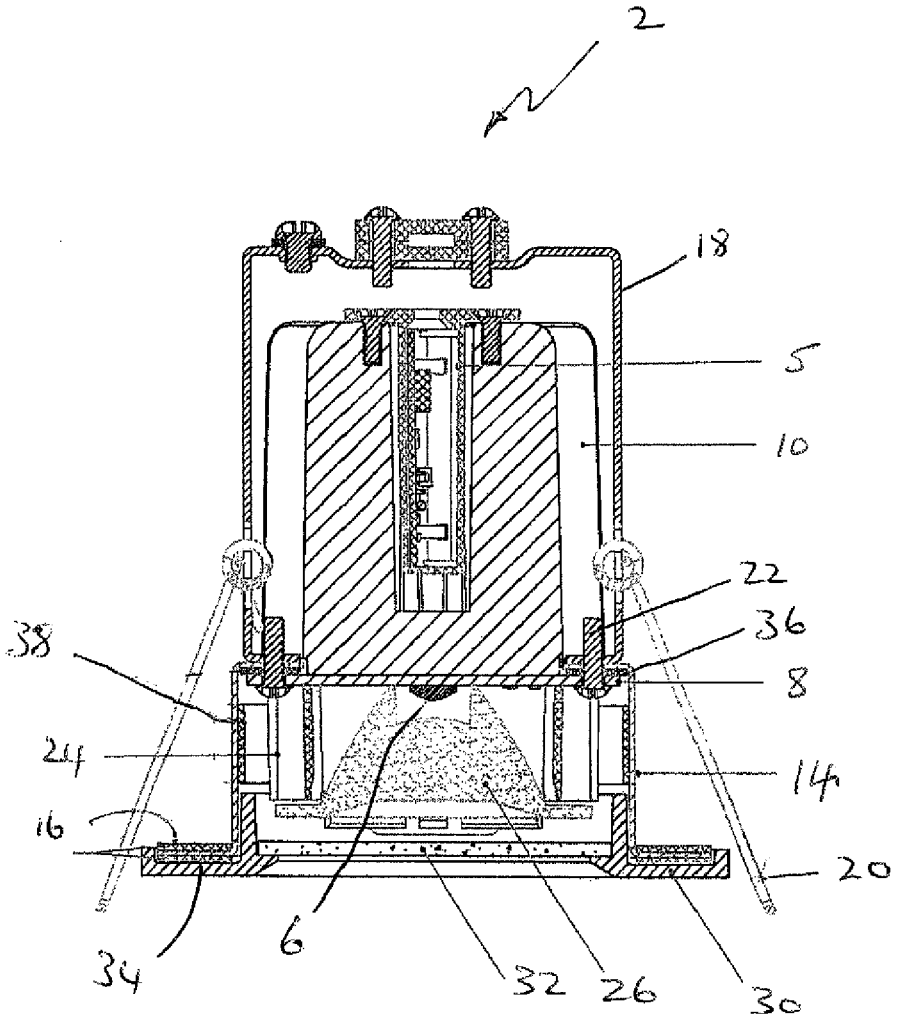
FIG. 1 shows a sectional view of a downlight design in accordance with the present invention.
Figure 2:
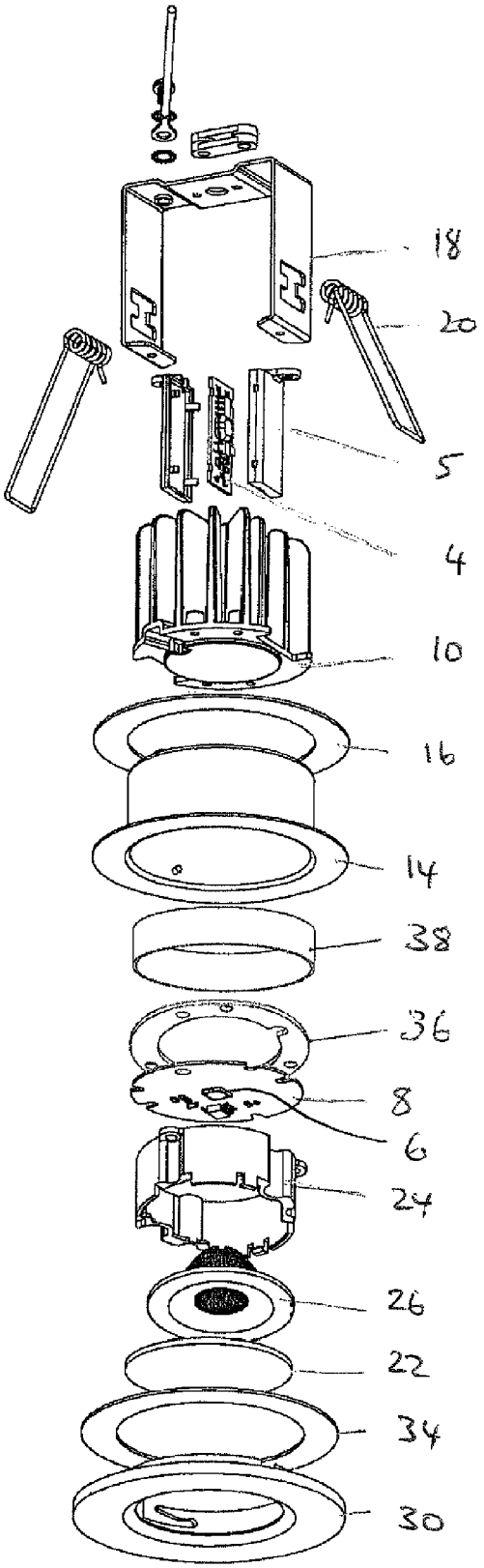
FIG. 2 shows an exploded component view of the downlight design of FIG. 1.

Referring first to FIGS. 1 and 2, there can be seen an embodiment of a downlight assembly, fixture or unit 2 according to the present invention.

The downlight unit 2 comprises a light source 6 in the form of an LED mounted to a circuit board 8, the circuit board including control circuitry for the light source 6 and together forming a solid state lighting unit. The term LED is used to mean an LED light engine and may or may not include any associated circuitry or other components depending on the context. The circuit board is made of a material having a relatively low melting point (in comparison to the fire rating test temperature) for example an aluminium or coated aluminium circuit board. The melting point of aluminium is around 660 degrees C., well below the temperature at which fire rating tests are performed.

Within the context of the present application, the reference to a melting point is a reference to the temperature at which the structural integrity of the circuit board can no longer be maintained. In the case of a metal circuit board, this is the melting point, but in the case of a ceramic circuit board, the meaning will readily be apparent to one skilled in the art.

The downlight unit further comprises a heat sink 10 provided to a rear side of the circuit board 8 and a lens arrangement located at a front side of the circuit board.

The circuit board 8 and the heat sink 10 are physically connected as described below. The circuit board is manufactured to have good thermal conductivity properties, for example from a material inherently having such properties or treated to have such properties. This allows for heat generated by the LED Light engine to pass efficiently to the heat sink. An aluminium PCB is one example of a suitable material for the LED circuit board.

The term "cylindrical casing" means conforming approximately to the shape of a hollow cylinder. It will be understood that a misshapen cylinder will work equally well.

Similarly, while the embodiments show a generally circular cylindrical tubular body other cross-sections may be used with amendment to the sectional shape of other components.

The heat sink 10 is formed from any suitable material, preferably cast or extruded aluminium. The heat sink 10 comprises at a lower end an outer annular portion for location against an upper portion of the cylindrical casing. The annular portion surrounds an end face of the heat sink. In the illustrated embodiment the end face is proud of the annular portion, such that once assembled the end face of the heat sink 10 extends through an opening in the rear face of the cylindrical casing 14 to form a good thermal contact with the rear face of the LED circuit board. Preferably a thermally conductive interface is provided between the LED circuit board and the heat sink. Suitable thermally conductive interfaces are, by way of example, thermally conductive grease, thermally conducting pads, graphite foil, or thermally conductive acrylic film.

The cylindrical casing or mounting ring 14 comprises a side wall or tubular body having a lower peripheral annular flange extending outwardly from a bottom end of the side wall to form a front face and an upper peripheral annular flange extending inwardly from an upper end of the side wall to form a rear face having an opening. The terms 'upper' and 'lower' in this context refer to the downlight assembly in the orientation as shown in the Figures. That is to say, the lower flange is located at or near the light emitting end of the mounting ring and is adapted to engage with the ceiling or other surface into which the downlight assembly is fitted. The upper flange is located at or near the opposite or rear end of the mounting ring, furthest from the light emitting end.

The mounting ring 14 is formed from any suitable material that will withstand the conditions experienced in fire rating tests, preferably steel. It will be understood that the melting point of steel is typically above the temperature used for fire rating tests and a suitable steel will be chosen with this in mind. It will also be understood that while the mounting ring in the present examples is of unitary construction, a composite mounting ring will work equally well providing all components are formed from materials that will withstand the conditions experienced in fire rating tests.

The upper peripheral annular flange of the mounting ring 14 locates against the annular portion of the heat sink 10 and the end face of the heat sink extends through the opening in the rear of the mounting ring formed by the upper flange. It can be seen that in this way, in this example, the heat sink substantially closes the opening at the rear of the mounting ring. It will also be appreciated that it is not necessary to close this opening completely since, in the event of a fire, a sleeve of intumescent material 38, described in more detail below, will expand to block and seal off the space within the mounting ring 14. In fact, it will be appreciated that leaving some ventilation route for air to circulate through the downlight assembly could offer a positive advantage in keeping the operating temperature of the LED/heat sink combination down. Alternatively, any sealing could be completed by another component, such as a bezel assembly described below.

A bracket 18 having depending legs and a central portion is provided in which spring biased members or clips 20 are mounted on each of the legs. Feet at the free ends of the legs are secured to the mounting ring 14.

A driver 4 is mounted within a driver box 5 in turn located within a recess in the heat sink 10. The driver box 5 is provided with flanges by which the driver box 5 may be secured to an upper part of the heat sink 10 by any suitable means.

The heat sink 10 is mounted on the mounting ring 14 with a front face of the heat sink 10 extending through the upper peripheral annular flange of the mounting ring 14.

A first ring or washer 16 of silicone is provided on the lower peripheral flange of the mounting ring 14. In practice, this ring or washer 16 of silicone provides a relatively airtight seal between the lower peripheral flange of the mounting ring 14 and a rim of a ceiling aperture into which the downlight fixture is fitted. This seal also serves to prevent water or other moisture, such as steam, from passing from a room into the space behind the ceiling.

The circuit board 8 is secured to the heat sink 10 by fasteners 22 extending through the mounting ring 14, such that the end face of the heat sink 10 is held in thermal contact with a substantial part of the rear surface of the circuit board 8. A periphery of the rear surface of the circuit board extends radially beyond the heat sink. In this way, once assembled, the LED circuit board 8 closes the opening at the rear of the mounting ring 14.

The fasteners 22 also serve to secure a lens holder in position. A lens holder 24 is used to locate a lens 26 in position. The lens holder 24 is secured in place to seat against the circuit board 8.

A glass 32 retained by a bezel 30, itself located within and by the mounting ring 14, is disposed in front of the lens 26 and lens holder 24. A second ring or washer 34 of silicone extends between the bezel 30 and the mounting ring 14. The space within the mounting ring 14 above the glass 32 defines a void within which the lens 26 is located by the lens holder 24.

The fasteners 22 extend through a ring or washer 36 of fireproof material or other non-thermally conductive material conveniently located between the periphery of the circuit board 8 and upper annular flange of the mounting ring 14. In this way the printed circuit board is kept separated from the mounting ring 14 and is not in direct thermal contact with the mounting ring 14. By non-thermally conductive is meant a material which is a poor conductor of heat, such as a material having a low thermal conductance value, for example a value of less than about 5 W/m K and preferably less than about 1 W/m K.

Preferably, the fireproof material of the ring or washer 36 takes the form of a ring of intumescent material.

In this example a collar or sleeve of 38 of intumescent fireproof material is located around an upper portion of the side wall of the mounting ring 14. Preferably, the fireproof material takes the form of a continuous sleeve of intumescent material. However, a discontinuous sleeve of intumescent material may be used instead.

The sleeve is of sufficient dimension that upon expansion due to heat in the event of a fire, the intumescent fireproof material expands to form a fireproof barrier within the mounting ring in order to protect the heat sink and LED circuit board. In the case of a sleeve of intumescent material, a continuous sleeve or a discontinuous sleeve can be selected to achieve the desired fire rating.

It will be understood that any suitable arrangement of intumescent material in the downlight assembly that achieves this objective of creating a fireproof barrier is suitable, and it need not necessarily be in the form of a sleeve. For example, if the LED circuit board was smaller in diameter than those illustrated in the Figures then there would be space for intumescent material to be located on the front face of the heat sink.

In this embodiment, it can be seen that the sleeve 38 covers around half of the internal surface of the tubular body of the mounting ring 14. An upper edge is located below the ends of the fasteners depending into the void. A lower edge of the sleeve 38 is located above the bezel 30 where the bezel 30 extends, in use, into the tubular body of the mounting ring.

In normal use, the heat generated by the solid state lighting unit is taken from the circuit board and dissipated via the heat sink 10. In this way the heat within the void is not sufficient to trigger expansion of the fireproof intumescent material.

However, in the event of a fire, or similarly a fire rating test, the greater temperatures to which the fireproof material is then subjected to will cause it to expand and fill the void with a barrier having fire resistant properties. This in turn protects the circuit board from damage by such temperatures allowing the structural integrity of the downlight assembly to be maintained for the duration of the fire rating test.

Accordingly, the combination of a substantially cylindrical mounting ring, the rear opening of which is substantially closed by a low melting point circuit board, which allows for efficient direct conduction of heat from the lighting unit to the heat sink, together with a sleeve of intumescent fireproof material which is only triggered on exposure to higher levels of heat than are normally present, enables the production of an improved fire rated downlight fixture utilising solid state technology.

Figure 3:
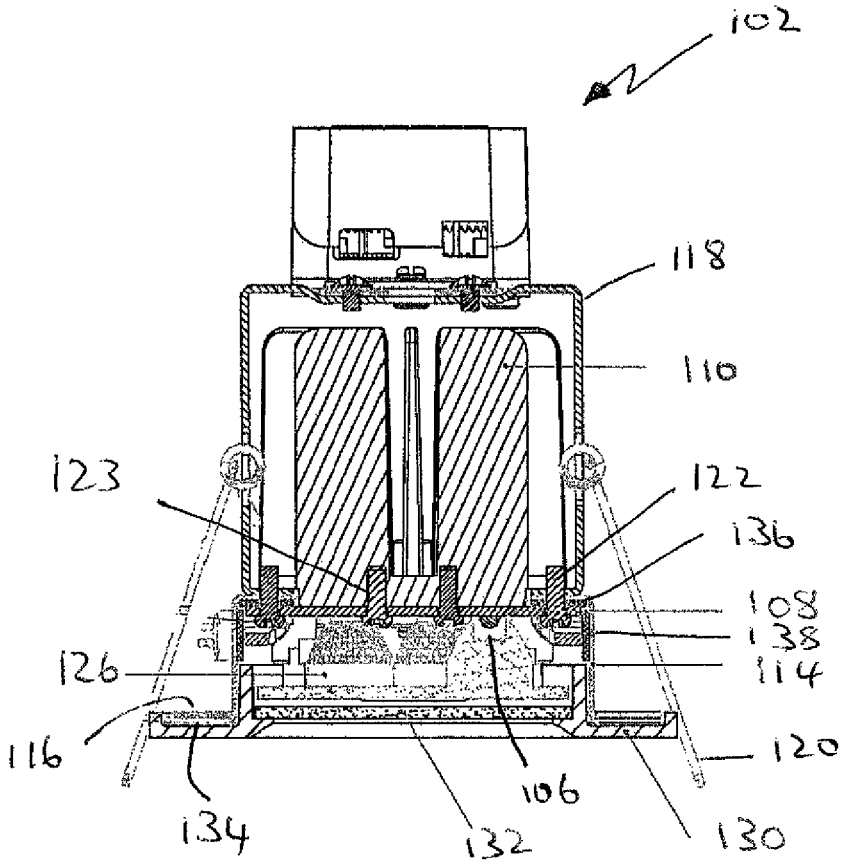
FIG. 3 shows a sectional view of a second downlight design in accordance with the present invention.
Figure 4:
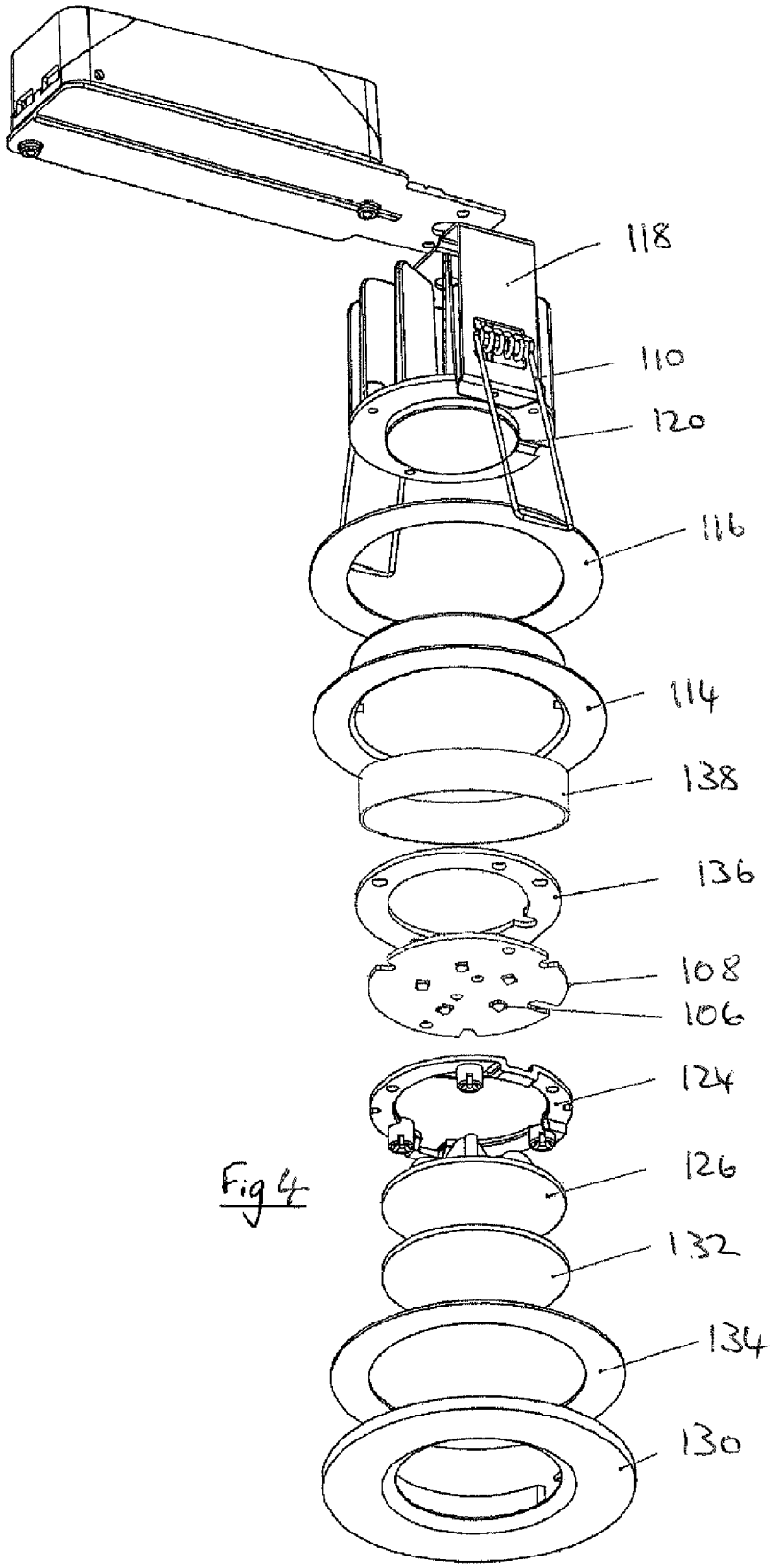
FIG. 4 shows an exploded component view of the downlight design of FIG. 3.

A further embodiment of the present invention is shown in FIGS. 3 and 4. There is shown a lighting unit in the form of a downlight unit 102 incorporating a terminal block, transformer unit or driver 104 provided on a mounting arm secured at one end to an upper end of the downlight unit 102.

In summary, the downlight assembly comprises a light source 106 in the form of a plurality of LEDs mounted on a circuit board 108 formed from a material having a melting point below 1000 degrees C., for example an aluminium printed circuit board, the circuit board optionally including control circuitry for the light source 106, a heat sink 110, a cylindrical casing or mounting ring 114 incorporating a sleeve of intumescent material 138, the heat sink 110 being provided to a rear side of the circuit board 108 and a lens arrangement located at a front side of the circuit board 108.

The mounting ring 114 is of a similar configuration to that of the previous embodiment, having a lower outwardly extending peripheral flange and an upper inwardly extending peripheral flange forming an opening in the rear face of the mounting ring, this opening being closed by the LED circuit board. This in effect forms a downlight can of two-part construction, the rear part of which is formed from a material having a melting point less than 1000 degrees centigrade.

A bracket 118 having depending legs and a central portion is provided in which spring biased members or clips 120 are mounted on each of the legs. Feet at the free ends of the legs are secured to the mounting ring 114.

The heat sink 110 is mounted on the mounting ring 114 via the bracket 118 with a front face of the heat sink 110 extending through the upper annular flange of the mounting ring 114 to close the rear of the mounting ring 114. This arrangement ensures that the heat sink is not in direct thermal contact with the mounting ring.

A first ring or washer 116 of silicone is provided on a lower peripheral flange of the mounting ring 114 to provide, in use, a seal between the lower peripheral flange of the mounting ring 114 and a rim of a ceiling aperture into which the downlight fixture is fitted.

The circuit board 108 is secured to the heat sink 110 by fasteners 122 passing through the mounting ring 114, such that the end face of the heat sink 110 is held in thermal contact with a rear surface of the circuit board 108. A periphery of the rear surface of the circuit board 108 extends radially beyond the heat sink to close the opening in the rear face of the mounting ring 114.

The circuit board 108 is conveniently also secured by fasteners 123 extending directly between the circuit board and the front face of the heat sink 110. Preferably the fasteners are made of a non-thermally conductive material.

The lens arrangement comprises a lens holder 124 and a lens 126. The lens holder 124 may be of any suitable material, for example a polycarbonate. The lens 126 may be of any suitable material, for example polymethylmethacrylate.

The lens 126 is retained in position relative to the light source 106 by the lens holder 124. The lens holder 124 is secured at its periphery to or through the upper peripheral flange of the mounting ring 114 in a suitable fashion, for example by utilising the screw fasteners 122 which also secure the bracket 118 to the mounting ring 114.

A bezel 130 is fitted to an underside of the mounting ring 114. The bezel 130 may be of any suitable material, for example cast aluminium. The bezel 130 comprises an inner wall having an inwardly directed shoulder toward a lower end and a radially outwardly directed annular flange at the lower end. The inner wall extends within the side wall of the mounting ring 114. In use the inner wall of the bezel and the side wall of the mounting ring are provided with cooperating features, such as male and female parts of a bayonet fixing, to enable the bezel 130 to be secured to the mounting ring 114. In use the inner shoulder supports a glass 132 located in front of the lens 126. The glass 132 is of any suitable material to allow transmission of the light emitted from the lens 126.

Preferably a second ring or washer 134 of silicone extends between the radially outwardly directed annular flange of the bezel 130 and the first peripheral flange of the mounting ring 114.

The fasteners 122 further extend through a ring or washer 136 of fireproof material or other non-thermally conductive material conveniently located between the periphery of the circuit board 108 and the upper annular flange of the mounting ring 114. In this way the printed circuit board 108 is kept separated from the mounting ring 114 and is not in direct physical contact, nor in thermal contact, with the mounting ring 114. Preferably the fasteners are made of a non-thermally conductive material Preferably, the fireproof material takes the form of a ring of intumescent material. A collar or sleeve of fireproof material is preferably located around an upper portion of the side wall of the mounting ring 114. Preferably, the fireproof material takes the form of a continuous sleeve of intumescent material. However, a discontinuous sleeve of intumescent material may be used instead.

In this embodiment, it can be seen that the sleeve 138 again covers around half of the internal surface of the tubular body of the mounting ring 114. However, in this embodiment, an upper edge of the sleeve 138 extends to or towards the upper end of the tubular body of the mounting ring 114. In a preferred embodiment, the upper edge of the sleeve encircles or is disposed about a periphery of the circuit board. A lower edge of the sleeve 138 is located above the inner wall of the bezel 130 where the bezel 130 extends, in use, into the tubular body of the mounting ring 114.

As in the first embodiment, in normal use, the heat generated by the solid state lighting unit is taken from the circuit board and dissipated via the heat sink 110. In this way the heat within the void is not sufficient to trigger expansion of the fireproof intumescent material.

However in the event of a fire, or similarly a fire rating test, the greater temperatures to which the fireproof material is then subjected to will cause it to expand and fill the void with a barrier having fire resistant properties. This in turn protects the circuit board 108 from damage by such temperatures allowing the structural integrity of the downlight assembly to be maintained for the duration of the fire rating test.

The invention claimed is:

1. A downlight assembly comprising:—

(i) a mounting ring having a tubular body with an opening at a rear, the mounting ring being formed from a material that withstands temperatures used for fire rating tests and having a lower peripheral annular flange extending outwardly from a bottom end of the tubular body, and an upper peripheral annular flange extending inwardly from an upper end of the tubular body, said upper peripheral annular flange enabling the rear of the mounting ring to be substantially closed if required;

(ii) a solid state lighting element comprising one or more LEDs mounted on a circuit board formed from a material having a melting point lower than 1000 degrees C.;

(iii) a heat sink formed from a material having a melting point lower than 1000 degrees C. and being in thermal contact with the solid state lighting element and located substantially outside the mounting ring; and (iv) intumescent material wherein the intumescent material is adapted to expand to fill or occlude the tubular body in the event of a fire;

wherein a ring or washer of non-thermally conductive material is located between the circuit board and the rear of the mounting ring.

2. The downlight assembly of claim 1 wherein the opening at the rear of the mounting ring is substantially closed by the heat sink.

3. The downlight assembly of claim 1 wherein the opening at the rear of the mounting ring is substantially closed by the solid state lighting element.

4. The downlight assembly of claim 1 the intumescent material is in the form of a sleeve.

5. The downlight assembly of claim 4 wherein the sleeve of intumescent material is continuous.

6. The downlight assembly of claim 4 wherein the sleeve of intumescent material is discontinuous.

7. The downlight assembly of claim 4 wherein the intumescent sleeve covers substantially half of the internal surface of the tubular body of the mounting ring.

8. The downlight assembly of claim 1 wherein the LED circuit board is not in direct thermal contact with the mounting ring.

9. The downlight assembly of claim 1 wherein the ring or washer of non-thermally conductive material comprises a fireproof material.

10. The downlight assembly of claim 9 wherein the ring or washer of fireproof material comprises an intumescent material.

11. The downlight assembly of claim 1 wherein the LED circuit board is formed from a material with a high thermal conductivity.

12. The downlight assembly of claim 1 wherein the circuit board is formed from a material having a melting point between 600 and 900 degrees C.

13. The downlight assembly of claim 1 wherein the LED circuit board is formed from aluminum.

14. The downlight assembly of claim 1 wherein the heat sink extends through the opening at the rear of the mounting ring into direct thermal contact with the solid state lighting element.

* * * * *